United States Patent [19]

Shultz

[11] Patent Number: 4,753,101

[45] Date of Patent: Jun. 28, 1988

[54] APPARATUS AND METHOD FOR EXPANDING AND SHAPING TUBULAR CONDUITS

[76] Inventor: William E. Shultz, 239 N. Main St., Lombard, Ill. 60148

[21] Appl. No.: 939,081

[22] Filed: Dec. 8, 1986

[51] Int. Cl.[4] ..... B21D 39/20

[52] U.S. Cl. ..... 72/393

[58] Field of Search ..... 254/104; 269/48.1; 72/393

[56] References Cited

U.S. PATENT DOCUMENTS

| | | | |
|---|---|---|---|
| 601,689 | 4/1898 | Wallis | 72/393 |
| 808,030 | 12/1905 | Faessler | 72/393 |
| 1,048,584 | 12/1912 | Rich | 72/393 |
| 1,176,232 | 3/1916 | Mauck | 72/393 |
| 2,999,529 | 9/1961 | Rast | 72/393 |
| 3,324,701 | 6/1967 | Shultz | 72/393 |

*Primary Examiner*—Lowell A. Larson

*Attorney, Agent, or Firm*—Mason, Kolehmainen, Rathburn & Wyss

[57] ABSTRACT

A tool for reshaping or expanding metal tubular material includes an expandable mandrel having a plurality of duplicate spreader segments held in a cluster by an elastic O-ring about a wedge-shaped cam member, each of the segments including an external, curved wall having a curvature corresponding to a curvature of an external curved wall in every other segment such that when all segments are equally spaced a predetermined amount, they form a cylinder having gaps between adjacent spreader segments for contact against an internal surface of said tubular material for reshaping or expanding said tubular material. The wedge-shaped cam member includes a plurality of external faces corresponding to a number of internal spreader segment faces sloped to converge toward a front, mandrel-insertion end of the cam member and shaped complementary to the shape of the internal spreader segment faces for sliding engagement of the segments over an adjacent external face of the cam member.

21 Claims, 2 Drawing Sheets

ROTATE 1/4 TURN

APPARATUS AND METHOD FOR EXPANDING AND SHAPING TUBULAR CONDUITS

FIELD OF THE INVENTION

The present invention is directed to a method and apparatus for expanding and/or shaping tubular conduits. More particularly, the present invention is directed to a method and apparatus for reshaping or expanding the internal diameter of any given tubular conduit utilizing an expandable, segmented mandrel and an internal driving wedge by forcing the wedge into an internal diameter of the segmented mandrel to expand the mandrel segments against an interior diameter of the conduit to be expanded or reshaped to round or otherwise reshape the internal diameter of the conduit.

BACKGROUND OF THE INVENTION AND PRIOR ART

Other tools have been developed for reshaping and restoring damaged or deformed tubular stock, such as the piping of automobile type exhaust systems, as shown in my prior U.S. Pat. No. 3,324,701. One of the disadvantages associated with the tool described in my prior U.S Pat. No. 3,324,701 is that a threaded handle has to be turned in order to expand a plurality of expandable segments prior to forcing the expandable segments into tubular stock for reshaping the tubular stock. The expandable segments are set initially to a desired diameter by axial movement of a wedge or cam member threaded to a central spindle or shaft. The stock is reshaped by forcing the expanded segments having tapered leading edges, into the stock and then removing the tool, further expanding the segments, and again forcing the segments into the stock to further reshape the interior of the stock by means of a hammer blow applied to the handle of the tool. The repeated removal and expanding of the device as well as the cumbersome wedge extending from the insertion end of the device makes its use very difficult.

SUMMARY OF THE INVENTION

The above disadvantages of the prior art have been overcome in accordance with the apparatus of the present invention since a pyramid-shaped wedge or cam member of the tool of the present invention is forced against the internal surfaces of the expandable segments by a blow of a hammer, or the like, by axial movement of the wedge or cam member thereby forcing the segments radially outwardly against the internal diameter of the tubular stock thereby reshaping the tubular stock. The blows of the hammer will force the wedge or pyramid-shaped cam member of the tool of the present invention into the expandable segments to increase the diameter of the expandable segments after insertion into the tubular conduit and force the segments against the internal diameter to expand or remove deformities in the tubular stock.

In accordance with the present invention, the blows of a hammer on the pyramid-shaped wedge or cam member forces the cam member into the expandable segments thereby forcing the expandable segments radially outwardly substantially without forcing the expandable segments axially into the tubular stock. In this manner, the individual segments are not forced into engagement with an end edge of the tubular stock and therefore the segments do not further damage or deform the tubular stock. Further, because the axial force applied to the cam member is transmitted radially to the expandable segments, the mechanic can grasp the tubular stock without mishap while applying hammer blows to a rear end surface of the cam member. Substantially the entire action of the hammer against the wedge or cam member results in forcing the expandable segments radially outwardly and not substantially axially into contact with the end edge of the tubular stock.

BRIEF DESCRIPTION OF THE DRAWING

FIG. 8 is a partially broken away, cross sectional view of the device of the present invention showing the capability of the device to expand a tubular conduit to an end diameter larger than its initial diameter.

DETAILED DESCRIPTION OF THE PREFERRED EMBODIMENT

Figures 1, 2, 3, 4:
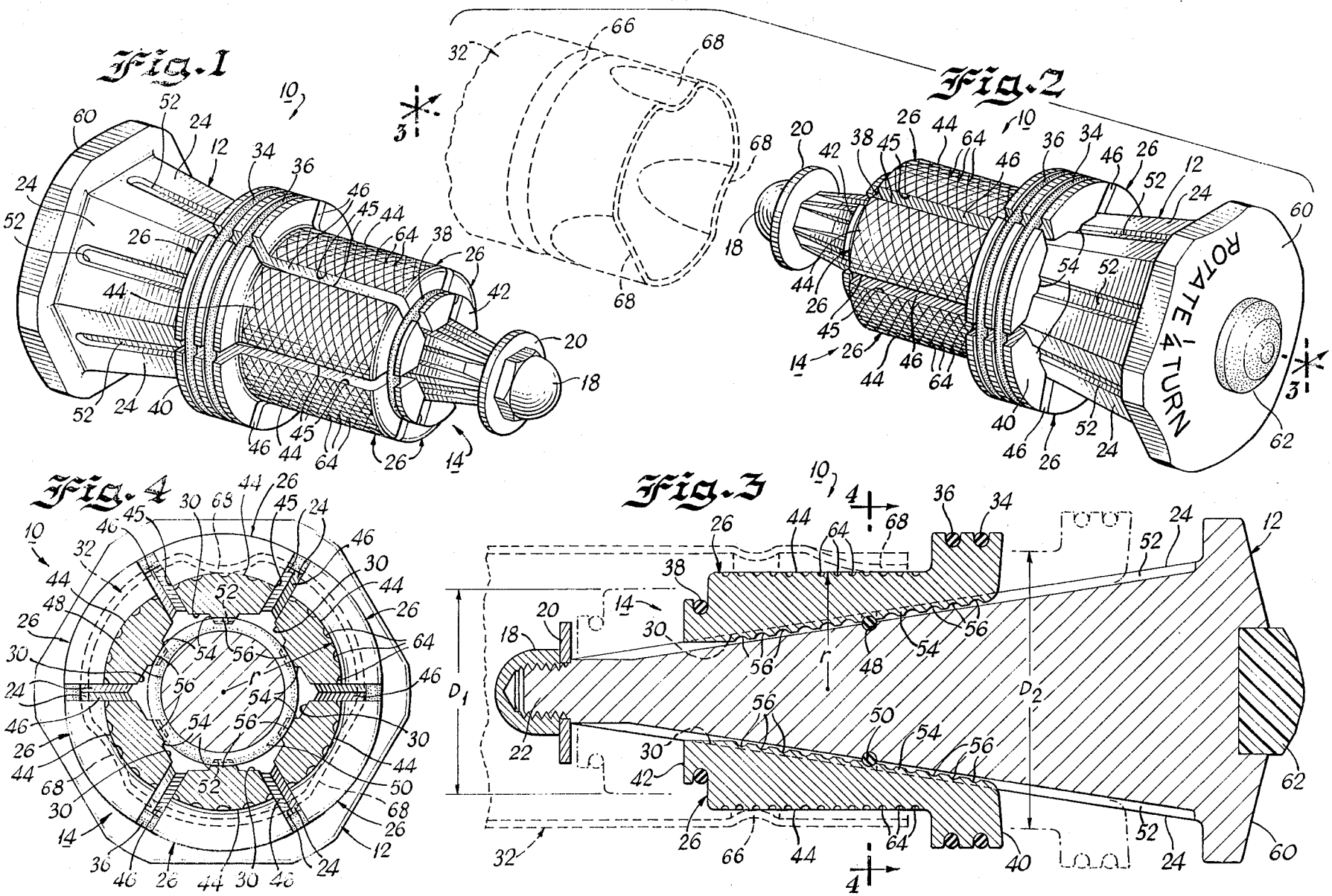
FIG. 1 is a perspective view of the device of the present invention.
FIG. 2 is another perspective view of the device of the present invention, similar to FIG. 1 showing a deformed tubular conduit, in dashed lines, ready to be expanded by the device.
FIG. 3 is a cross-sectional view of the device of the present invention, taken through the line 3—3 of FIG. 2, showing a central initial setting for the mandrel of the device of FIGS. 2–4 in solid lines; a smallest initial setting for the mandrel ($D_1$) and a most expanded mandrel in dashed lines ($D_2$)
FIG. 4 is a cross-sectional view of the device of the present invention taken through the line 4—4 of FIG. 3.

Turning now to the drawings and initially to FIG. 1, there is shown a new and improved device, generally designated by reference numeral 10, for expanding and/or reshaping a tubular conduit. The device 10 includes a wedge-shaped cam member generally designated by reference numeral 12; and one or a plurality of expandable mandrels, generally designated by reference numerals 14 and 16 held in an expandable cluster about the wedge-shaped cam member by threaded interlocking of nylon-lined self locking acorn nut 18 and washer 20 onto a threaded, smallest diameter portion 22 of the wedge-shaped cam member 12. The wedge-shaped cam member 12 is in the form of a hexagonal pyramid having six identical external faces 24 extending in uniformly converging relation in a direction toward the smallest diameter end 22 of the wedge-shaped cam member 12.

The expandable mandrels 14 and 16 include a number of separate and duplicate spreader segments 26 or 28, the number of segments corresponding to the number of faces 24 on the wedge-shaped cam member 12. It is understood that the number of external faces 24 of the wedge-shaped cam member 12 and the number of duplicate spreader segments 26 or 28 of the expandable mandrels 14 or 16 can be other than six in accordance with the present invention so long as the number of external wedge faces 24 corresponds to the number of internal faces 30 on the spreader segments. The interior faces 30 on each of the duplicate spreader segments 26 and 28 of the expandable mandrels 14 and 16 are sloped complementary to the slope on each of the faces 24 of the wedge-shaped cam member 12 for sliding engagement of the sloped interior surfaces 30 of segments 26 and 28 over the external faces 24 of the wedge-shaped cam member 12 as the wedge-shaped cam member 12 is forced axially into the expandable mandrel to expand the segments 26 or 28 radially outwardly without substantially forcing the expandable mandrel 14 or 16 or its spreader segments 26 or 28 axially into the tubular conduit 32.

The expandable segments 26 and 28 of the mandrels 14 and 16 are maintained in sliding contact with the faces 24 of the wedge-shaped cam member 12 by flexible retainers or elastic O-rings 34, 36 and 38. Elastic O-rings 34 and 38 are positioned near end surfaces 40 and 42, respectively, of the expandable mandrels 14 or 16 to maintain the segments 26 or 28 in a cluster about the cam member 12 with a segment 26 or 28 opposite and in contact with each of the faces 24 of the wedge-shaped cam member 12. An intermediate elastic O-ring 36, disposed adjacent to O-ring 34 helps to maintain the segments in axial alignment, after spreading, as shown in FIGS. 1, 2 and 4.

Figures 4, 5, 6, 7:
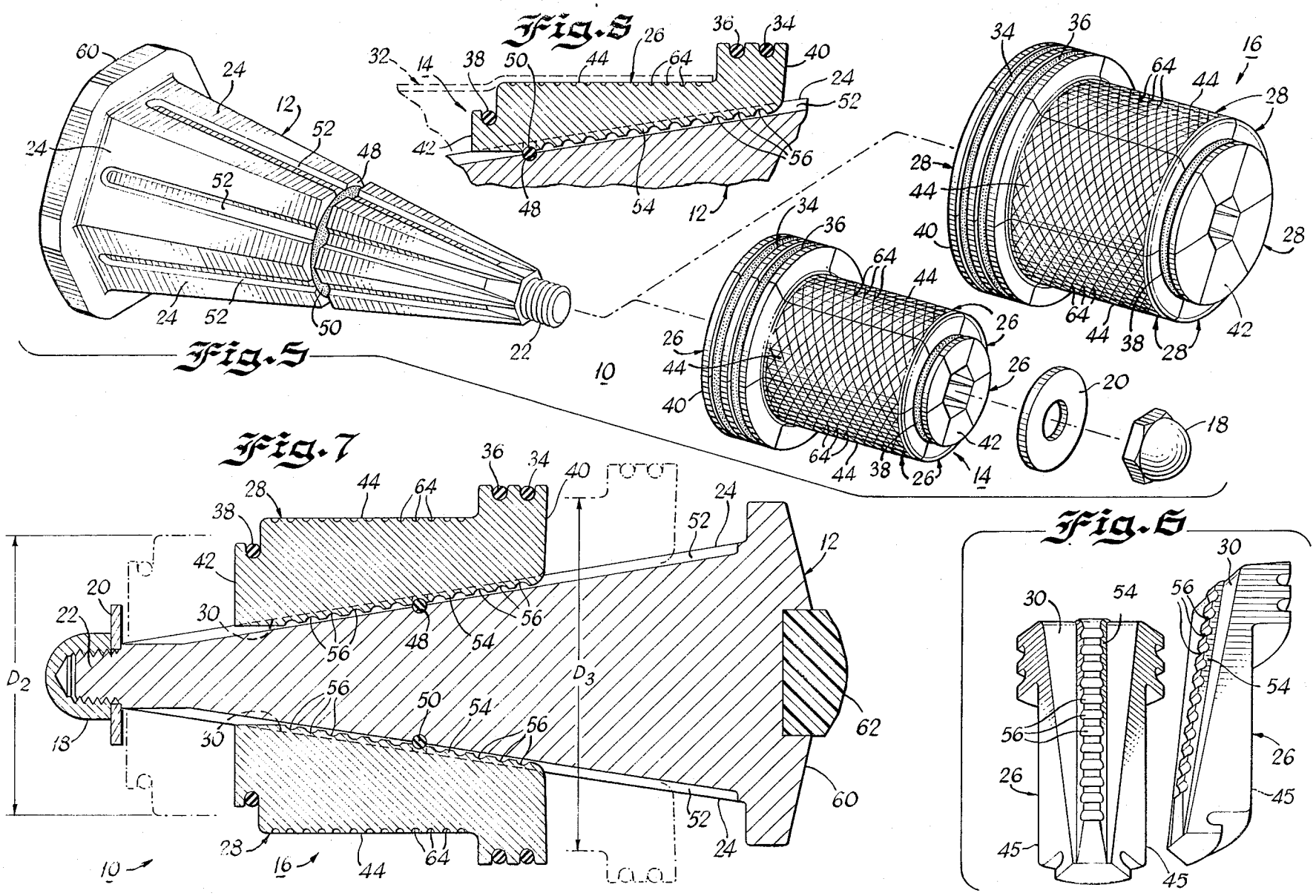
FIG. 5 is an exploded perspective view of the device of the present invention in kit form having a pair of differently sized expandable mandrels.
FIG. 6 is a perspective view of two adjacent expandable segments forming a portion of the six-segment expandable mandrel into which the pyramid-shaped, six-sided wedge or cam member is forced for expansion in accordance with the method and apparatus of the present invention.
FIG. 7 is a cross-sectional view of the device of the present invention including a larger mandrel than the mandrel of FIGS. 1–4 and 8, having a range of expansion between $D_2$ of FIG. 3 and $D_3$.

As best seen in FIGS. 3 and 7, when the mandrel 14 or 16 is positioned in a cluster about the wedge-shaped cam member 12, the segments 26 or 28 have their interior faces 30 sloped complementary to the faces 24 of the wedge-shaped cam member 12 such that the interior faces 30 of each of the spreader segments 26 and 28 slope to converge toward the outer surface 44 from a front or leading surface 42 uniformly in a direction toward a rearward surface 40 of each of the spreader segments 26 and 28 while maintaining essentially cylindrical outer, tubular conduit-contacting outer surfaces 44 at each different position of the spreader segments 26 or 28 along the faces 24 of the wedge-shaped cam member 12.

In accordance with one important embodiment of the present invention, each of the spreader segments 26 is initially shaped to have a radius (FIGS. 3 and 4) such that when the spreader segments 26 are approximately centrally disposed axially with respect to the external faces 24 of the wedge-shaped cam member 12, as shown in solid lines in FIG. 3, the outer surfaces 44 of the spreader segments 26 form a perfect cylinder having a plurality of essentially equally spaced gaps or spaces 46 between each of the segments 26.

Since the outer curved walls 44 of each of the spreader segments are formed with a predetermined radius r (FIGS. 3 and 4), as the segments 26 are expanded from the solid line position of FIG. 3, the radius of curvature of the spreader segments will be less than the radius of curvature of the tubular conduit 32, so that the outer surface 44 of the segments will contact the interior tube diameter only at a central portion (about $\frac{1}{3}$ to $\frac{1}{2}$ of the central outer curved wall area). Similarly, as the segments are positioned toward the leading edge 22 of the cam member 12, the curvature of the outer walls 44 will be greater than the curvature of the interior diameter of the tubular conduit so that the outer walls 44 will only contact the interior tube diameter at a surface area ($\frac{1}{3}$ to $\frac{1}{2}$ of the total outer wall area) adjacent the longitudinal edges 45. To achieve the full advantage of the present invention, therefore, the mandrel should form a cylinder when approximately centrally disposed, axially, on the cam member 12, as shown in FIG. 3.

In accordance with another important feature of the present invention, the wedge-shaped cam member 12 includes a continuous groove 48 extending continuously through each of the external faces 24 of the wedge-shaped cam member 12 and disposed circumferentially around the wedge shaped cam member 12 through each of the external faces 24 of the cam member 12. An elastomeric O-ring 50 is disposed within the circumferential groove 48 continuously encircling the wedge-shaped cam member 12 at approximately the axial mid-point thereof and extending upwardly within central grooves 52 longitudinally and centrally machined or cast into each of the faces 24 of the wedge-shaped cam member 12. The longitudinal central grooves 52 in each of the external faces 24 of the cam member 12 maintain the segments 26 or 28 in a line of travel centrally along each face 24 of the wedge-shaped cam member 12 during radial expansion and contraction of the segments 26 and 28.

These longitudinal, central grooves 52 in each of the faces 24 of the cam member 12 provide a guide path for receiving a centrally disposed raised rib 54 extending outwardly from each of the interior faces 30 of each of the spreader segments 26 or 28 to maintain each spreader segment 26 or 28 centrally disposed along each external wedge face 24 of the cam member 12 during radial expansion and contraction of the spreader segments 26 or 28. The raised ribs 54 machined or cast in and extending outwardly from the interior surfaces 30 of each of the spreader segments 26 or 28 include a plurality of parallel notches 56 each adapted to receive the elastomeric O-ring 50 disposed in groove 48 on the wedge-shaped cam member 12 for holding the expandable mandrel 14 or 16 and its segments 26 or 28 in position on the wedge-shaped cam member 12 as the expandable mandrel 14 or 16 is spread to reshape or expand a tubular conduit.

To achieve the full advantage of the present invention, a rearward end 60 of the wedge-shaped cam member 12 includes a polymeric insert portion 62 centrally disposed in the rearward end 60 of the cam member 12 and extending outwardly therefrom for receiving a blow from a hammer or other device in order to prevent damage to the rearward end 60 of the cam member 12 and to prevent metal parts from being chipped off of the rearward end 60 to avoid eye damage and the like to the user of the device 10. The polymeric insert aids in transmitting the axial force as a "dead blow" to the spreader segments for radial expansion without shock transmitted through the device to the tubular conduit sometimes being grasped by the mechanic. A suitable, durable plastic material useful in accordance with the present invention is a nylon such as DALRON although any other durable plastic is suitable in accordance with the principles of the present invention.

In accordance with a preferred embodiment of the present invention, as shown in the drawings, the cam member 12 and spreader segments 26, 28 are cast from aluminum and the outer surfaces 44 of each of the expandable segments 26 or 28 are provided with suitable grooves or knurls 64 for gripping engagement against an interior diameter of a tubular conduit or other workpiece for removal of rust or other undesirable surface materials on the interior diameter of a tubular conduit and to prevent slippage of the expandable mandrels from the interior diameter of the workpiece. Aluminum functions without breakage because the axial force is essentially transferred into a radial force to the extensive outer surfaces 44 of the segments 26, 28.

As shown in FIGS. 2–4, the device of the present invention is excellent for removing a circumferential indentation 66 in the tubular conduit 32, such as that caused by a pipe clamp or mitten clamp when two conduits are mechanically secured together, particularly automotive exhaust conduits. Similarly, end deformities 68 (FIG. 2) commonly encountered in tubular conduits are easily and unexpectedly removed in accordance with the method and apparatus of present invention.

While there has been described what is at present considered to be the preferred embodiment of the invention, it will be understood that various modifications may be made therein which are within the true spirit and scope of the invention.

What is claimed as new and desired to be secured by Letters Patent of the United States is:

1. A tool for reshaping or expanding metal tubular stock comprising:

an expandable mandrel including a plurality of spreader segments held in a cluster about a wedge-shaped cam member said spreader segments having internal faces including elongated raised ribs extending outwardly;

a wedge-shaped cam member including a plurality of external faces corresponding to a number of internal faces on the spreader segments wherein the external faces of the cam member include a circumferential groove containing a raised O-ring for contact against the raised ribs on the spreader segments to hold the spreader segments in a desired axial position with respect to the external cam faces as the cam member is forced into the expandable mandrel; and means for flexibly retaining said spreader segments adjacent to the external faces of the cam member in a cluster about the cam member while allowing sliding engagement of said segments over the external faces of the cam member; the external faces of said cam member being shaped complementary to the internal faces of the spreader segments whereby an axial force applied to the cam member moves the cam member axially relative to said mandrel and said spreader segments thereby causing the segments to be moved radially outwardly.

2. The tool of claim 1 wherein said external surfaces of said cam member form a pyramid shape with the external cam surfaces converging in a direction toward a mandrel-insertion end thereof.

3. The tool of claim 2 wherein the external surfaces of the pyramid-shaped cam member are planar and include alignment means for maintaining the spreader segments in alignment with the cam member external surfaces.

4. The tool of claim 3 wherein the alignment means comprises an elongated groove in an external cam member face and a corresponding elongated rib extending from an adjacent planar spreader segment face to maintain the internal, planar spreader segment faces and the external, planar cam member faces in alignment and in striking engagement during expansion and contraction of the spreader segments during insertion and removal of the cam member.

5. The tool of claim 4 wherein the external cam member faces include a circumferential groove containing a raised O-ring, and the elongated raised ribs extending from the internal faces of the spreader segments include a plurality of notches forming spaced teeth in the elongated ribs disposed to receive the raised O-ring between adjacent teeth.

6. The tool of claim 5 wherein the internal faces of each spreader segment includes an elongated rib having adjacent raised teeth defining notches therebetween adapted to receive a portion of the raised O-ring disposed circumferentially around the cam member wherein the number and disposition of teeth and notches on each of the spreader segments correspond from one spreader segment to another for axial alignment of all spreader segments about the cam member to maintain the expandable mandrel in an axially aligned cluster of spreader segments as the cam member is forced into or out of the expandable mandrel by forcing the O-ring into a different notch in each segment rib.

7. The tool of claim 5 wherein the elongated, raised ribs extending outwardly from the internal faces of the spreader segments includes a plurality of notches shaped to receive the circumferential raised O-ring on the cam member.

8. The tool of claim 7 wherein the internal faces of the spreader segments are sloped to converge in a direction opposite to the converging slope of the external faces on the cam member when the segments are held in a cluster about the cam member and sloped correspondingly to the slope of the external cam member faces so that longitudinal exterior surfaces of the spreader segments are maintained essentially parallel to a central axis of the cam member during expansion and contraction of the expandable mandrel.

9. A tool for reshaping or expanding metal tubular material comprising:

an expandable mandrel including a plurality of duplicate spreader segments held in a cluster by an elastic O-ring about a wedge-shaped cam member, said spreader segments including an internal face sloped to converge toward a rearward end of the cam member and shaped complementary to an adjacent external face of the wedge-shaped cam member and having a raised, elongated, longitudinally disposed rib extending outwardly from the internal face of the spreader segments and adapted to be received within tte adjacent cam member surface, said elongated ribs including a plurality of adjacent teeth having notches therebetween adapted to receive an O-ring circumferentially disposed around the cam member;

each of said segments including an external, curved wall having a curvature corresponding to a curvature of an external curved wall in every other segment such that when all segments are equally spaced a predetermined amount, they form a cylinder having gaps between adjacent spreader segments for contact against an internal surface of said tubular material for reshaping or expanding said tubular material;

a wedge-shaped cam member including a plurality of external faces corresponding to a number of said internal spreader segment faces sloped to converge toward a front, mandrel-insertion end of the cam member and shaped complementary to the shape of the internal spreader segment faces for sliding engagement of said segments over an adjacent external face of the cam member, said external cam member faces each including an elongated groove axially aligned with the cam member and adapted to receive the raised rib extending from the internal face of the spreader segments; said cam member including walls defining a circumferential groove around the cam members; an O-ring disposed within the groove and extending upwardly from the external cam member surfaces such that said O-ring is disposed to be received within the notches in different segment ribs as the mandrel is expanded or contracted by axial movement of the cam member with respect to said mandrel; and means for flexibly retaining said spreader segments adjacent to the external faces of the cam member in a cluster about the cam member for sliding engagement of the segments over the external faces of the cam member.

10. The tool of claim 9 wherein the O-ring circumferentially disposed around the cam member is axially centrally disposed about the cam member.

11. The tool of claim 9 wherein the O-ring is elastic.

12. A method of reshaping or expanding metal tubular stock comprising:

inserting an expandable mandrel having a plurality of spreader segments including elongated raised ribs extending outwardly internally within a metal tubular article wherein said mandrel includes means for flexibly retaining said spreader segments adjacent to external faces of a cam member in a cluster about the cam member while allowing sliding engagement of said segments over the external faces of the cam member; the external faces of said cam member being shaped complementary to the internal faces of the spreader segments whereby an axial force applied to the cam member moves the cam member axially relative to said spreader segments thereby causing the segments to be moved radially outwardly wherein the external faces of the cam member include a circumferential groove containing a raised O-ring for contact against the raised ribs on the spreader segments to hold the spreader segments in a desired axial position with respect to the external cam faces as the cam member is forced into the expandable mandrel;

axially forcing the cam member into the expandable mandrel to spread the spreader segments radially outwardly against an internal surface of the tubular article, said cam member including a tapered front, a mandrel-inserting end and a plurality of external faces slidingly engaged against the internal faces of the spreader segments, the external faces of the cam member being shaped complementary to the internal faces of the cam member in a cluster about the cam member while allowing sliding engagement of said segments over the external faces of the cam member; the external faces of said cam member being shaped complementary to the internal faces of the spreader segments whereby an axial force applied to the cam member moves the cam member axially relative to said mandrel and said spreader segments thereby causing the segments to be moved radially outwardly for reshaping or expanding the tubular article; and removing the mandrel and the cam member from the tubular article.

13. The method of claim 12 wherein said external surfaces of said cam member form a pyramid shape with the external cam surfaces converging in a direction toward a mandrel-insertion end thereof.

14. The method of claim 13 wherein the external surfaces of the pyramid-shaped cam member are planar and include alignment means for maintaining the spreader segments in alignment with the cam member external surfaces.

15. The method of claim 14 wherein the alignment means comprises an elongated groove in an external cam member face and a corresponding elongated rib extending from an adjacent planar spreader segment face to maintain the internal, planar spreader segment faces and the external, planar cam member faces in alignment and in striking engagement during expansion and contraction of the spreader segments during insertion and removal of the cam member.

16. The method of claim 15 wherein the external cam member faces include a circumferential groove containing a raised O-ring, and the elongated raised ribs extending from the internal faces of the spreader segments include a plurality of notches forming spaced teeth in the elongated ribs disposed to receive the raised O-ring between adjacent teeth.

17. The method of claim 16 wherein the internal faces of each spreader segment includes an elongated rib having adjacent raised teeth defining notches therebetween adapted to receive a portion of the raised O-ring disposed circumferentially around the cam member wherein the number and disposition of teeth and notches on each of the spreader segments correspond from one spreader segment to another for axial alignment of all spreader segments about the cam member to maintain the expandable mandrel in an axially aligned cluster of spreader segments as the cam member is forced into or out of the expandable mandrel by forcing the O-ring into a different notch in each segment rib.

18. The method of claim 12 wherein the elongated, raised ribs extending outwardly from the internal faces of the spreader segments includes a plurality of notches shaped to receive the circumferential raised O-ring on the cam member.

19. The method of claim 18 wherein the internal faces of the spreader segments are sloped to converge in a direction opposite to the converging slope of the external faces on the cam member when the segments are held in a cluster about the cam member and sloped correspondingly to the slope of the external cam member faces so that longitudinal exterior surfaces of the spreader segments are maintained essentially parallel to a central axis of the cam member during expansion and contraction of the expandable mandrel.

20. A tool kit for reshaping or expanding metal tubular stock comprising:

a pair of expandable mandrels each mandrel including a plurality of spreader segments capable of being held in a cluster about a wedge-shaped cam member said spreader segments having internal faces including elongated raised ribs extending outwardly, said spreader segments of one mandrel being of different outer curvature than the spreader segments of the other mandrel and adapted to be held in a cluster about a single cam member;

a wedge-shaped cam member including a plurality of external faces corresponding to a number of internal faces on the spreader segments wherein the external faces of the cam member include a circumferential groove containing a raised O-ring for contact against the raised ribs on the spreader segments to hold the spreader segments in a desired axial position with respect to the external cam faces as the cam member is forced into the expandable mandrel; and means for flexibly retaining said spreader segments of one of the mandrels adjacent to the external faces of the cam member in a cluster about the cam member while allowing sliding engagement of said segments over the external faces of the cam member; the external faces of said cam member being shaped complementary to the internal faces of the spreader segments whereby an axial force applied to the cam member moves the cam member axially relative to said mandrel and said spreader segments thereby causing the segments to be moved radially outwardly.

21. A tool for reshaping or expanding metal tubular stock comprising:

an expandable mandrel including a plurality of spreader segments held in a cluster about a wedge-shaped cam member;

a wedge-shaped cam member including a plurality of external faces corresponding to a number of internal faces on the spreader segments;

means for flexibly retaining said spreader segments adjacent to the external faces of the cam member in a cluster about the cam member while allowing sliding engagement of said segments over the external faces of the cam member; the external faces of said cam member being shaped complementary to the internal faces of the spreader segments whereby an axial force applied to the cam member moves the cam member axially relative to said mandrel and said spreader segments thereby causing the segments to be moved radially outwardly; and means operatively disposed on the internal faces of the expandable mandrel and on the external faces of the cam member to maintain the axial position of the cam member within the mandrel as the cam member is forced into the mandrel.

* * * * *